US011584980B2

(12) United States Patent
Garcia Martino et al.

(10) Patent No.: US 11,584,980 B2
(45) Date of Patent: Feb. 21, 2023

(54) APPARATUS FOR DIP-COATING A METAL STRIP USING A MOVABLE OVERFLOW

(71) Applicant: ArcelorMittal, Luxembourg (LU)

(72) Inventors: Angel Garcia Martino, Asturias (ES); Inocencio Garcia-Chapa, Asturias (ES)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 17/054,613

(22) PCT Filed: Apr. 3, 2019

(86) PCT No.: PCT/IB2019/052732
§ 371 (c)(1),
(2) Date: Nov. 11, 2020

(87) PCT Pub. No.: WO2019/224617
PCT Pub. Date: Nov. 28, 2019

(65) Prior Publication Data

US 2021/0180171 A1 Jun. 17, 2021

(30) Foreign Application Priority Data

May 25, 2018 (WO) ..... PCT/IB2018/053726

(51) Int. Cl.

| | |
|---|---|
| ***C23C 2/06*** | (2006.01) |
| ***C23C 2/40*** | (2006.01) |
| ***C23C 2/00*** | (2006.01) |
| ***C21D 9/54*** | (2006.01) |
| ***C23C 2/02*** | (2006.01) |

(52) U.S. Cl.
CPC ..... *C23C 2/003* (2013.01); *C21D 9/54* (2013.01); *C23C 2/02* (2013.01); *C23C 2/06* (2013.01); *C23C 2/40* (2013.01)

(58) Field of Classification Search
None
See application file for complete search history.

(56) References Cited

U.S. PATENT DOCUMENTS

2004/0028832 A1* 2/2004 Dauchelle ..... C23C 2/00 118/400
2004/0052958 A1 3/2004 Dauchelle et al.
(Continued)

FOREIGN PATENT DOCUMENTS

CN 102127727 B 7/2011
CN 107447174 A 12/2017
(Continued)

*Primary Examiner* — Binu Thomas
(74) *Attorney, Agent, or Firm* — Davidson, Davidson & Kappel, LLC

(57) ABSTRACT

An equipment for the continuous hot dip-coating of a metal strip including an annealing furnace, a tank containing a liquid metal bath, a snout connecting the annealing furnace and the tank, through which the metal strip runs in a protective atmosphere and the lower part of the snout, the snout tip, is at least partly immersed in the liquid metal bath in order to define with the surface of the bath, and inside this snout, a liquid seal and a separate overflow attached/hold to the snout through fixings, the overflow including at least one tray, placed in the vicinity of the strip when entering the liquid metal bath and encompassed by the liquid seal.

15 Claims, 7 Drawing Sheets

(56) References Cited

U.S. PATENT DOCUMENTS

| | | | | |
|---|---|---|---|---|
| 2016/0102393 | A1* | 4/2016 | Schaffrath | C23C 2/003 118/712 |
| 2019/0062888 | A1* | 2/2019 | Saint-Raymond | C23C 2/003 |
| 2019/0144982 | A1* | 5/2019 | Veg | C23C 2/003 118/400 |
| 2020/0399749 | A1* | 12/2020 | Garcia Martino | C23C 2/003 |

FOREIGN PATENT DOCUMENTS

| | | | | |
|---|---|---|---|---|
| DE | 112013004765 | T5 | | 7/2015 |
| DE | 112013004765 | T5 | | 7/2015 |
| FR | 2 816 639 | A1 | | 5/2002 |
| JP | 2009-068043 | A | | 4/2009 |
| JP | 2009068043 | A | * | 4/2009 |
| JP | 2014065950 | A | | 4/2014 |
| KR | 20020037542 | A | | 5/2002 |
| WO | WO2017187225 | A1 | | 11/2017 |

* cited by examiner

APPARATUS FOR DIP-COATING A METAL STRIP USING A MOVABLE OVERFLOW

The present invention relates to an equipment for the hot dip-coating of a metal strip.

BACKGROUND

During the coating process, the entering position of the strip into the bath changes over time due to different factors, e.g. changes in the strip entry position and/or bath level. Thus the optimal position of the overflow varies. Consequently, the overflow needs to be shifted and moved to the optimal position during the process.

Moreover, while in use, the equipment deteriorates or breaks down due to various effects. For example, the immersed part of the snout is subject to corrosion, the pump or the level indicator of the overflow happens to malfunction. In order to overcome those issues, some part of the snout or the overflow needs to be replaced or repaired, such operations lead to the strip cut, a decrease in productivity and higher cost of manufacturing.

Patent FR 2 816 639 relates to an apparatus for the continuous dip coating of a metal strip. This equipment improves the surface quality of the strip by reducing its defect density by adding an overflow to the snout. In order to do so, overflows are installed in the lengthening of the snout, collecting the dross near the strip.

Patent WO 2017/187225 describes an apparatus for the continuous dip coating of a metal strip. This equipment improves the apparatus from FR 2 816 639 explained above and allows the position tuning of the snout and the overflows regards the strip. In order to do so, the snout is equipped with a mobile box of discharge in rotation in regards to the metal strip around a first axis of rotation and the box of discharge is mobile in rotation compared to the upper part of the sheath around a second axis of rotation. Moreover, the articulation allowing the rotation of the box of discharge compared to the upper part of the sheath is a connection pivot.

However, by using the above equipment, the right setting of the overflow is complex and, if not handled properly, may lead to inadequate positioning. The setting complexity is due to the difficulties of levelling both sides of the overflow by making a horizontal displacement without vertical displacement. Moreover, this needs lot of mechanisms leading up to higher probability of failure. Furthermore, when one part is broken, in order to repair it, the whole snout has to be removed and sometimes replaced.

SUMMARY OF THE INVENTION

Consequently, there is a need to find a simpler and more reliable overflow tuning device, as well as one easing its replacement. The solution should also ease the correct positioning of the overflow. Furthermore, it would be very advantageous, if the overflow could be removed without cutting the strip so it remains threaded and reduces the impact on the production.

The present invention provides an equipment for the continuous hot dip-coating of a metal strip (19) comprising: an annealing furnace, a tank (18) containing a liquid metal bath, a snout connecting the annealing furnace and said tank, through which the metal strip runs in a protective atmosphere and the lower part of said snout, the snout tip (1), is at least partly immersed in the liquid metal bath in order to define with the surface of the bath, and inside this snout (2), a liquid seal, a separate overflow (3) attached to the snout through fixings (4), said overflow comprising at least one tray (5), placed in the vicinity of the strip when entering said liquid metal bath and encompassed by said liquid seal.

The present invention also provides a method for depositing a metallic coating by hot-dip coating in such equipment comprising: the recrystallization annealing of the steel sheet in an annealing furnace, the passage of the steel sheet from the annealing furnace to the hot-dip coating bath in the snout, and the hot dip-coating of the annealed steel sheet in said liquid metal bath.

Other characteristics and advantages of the invention will become apparent from the following detailed description of the invention.

BRIEF DESCRIPTION OF THE DRAWINGS

To illustrate the invention, various embodiments and trials of non-limiting examples will be described, particularly with reference to the following figures.

DETAILED DESCRIPTION

Figure 1:
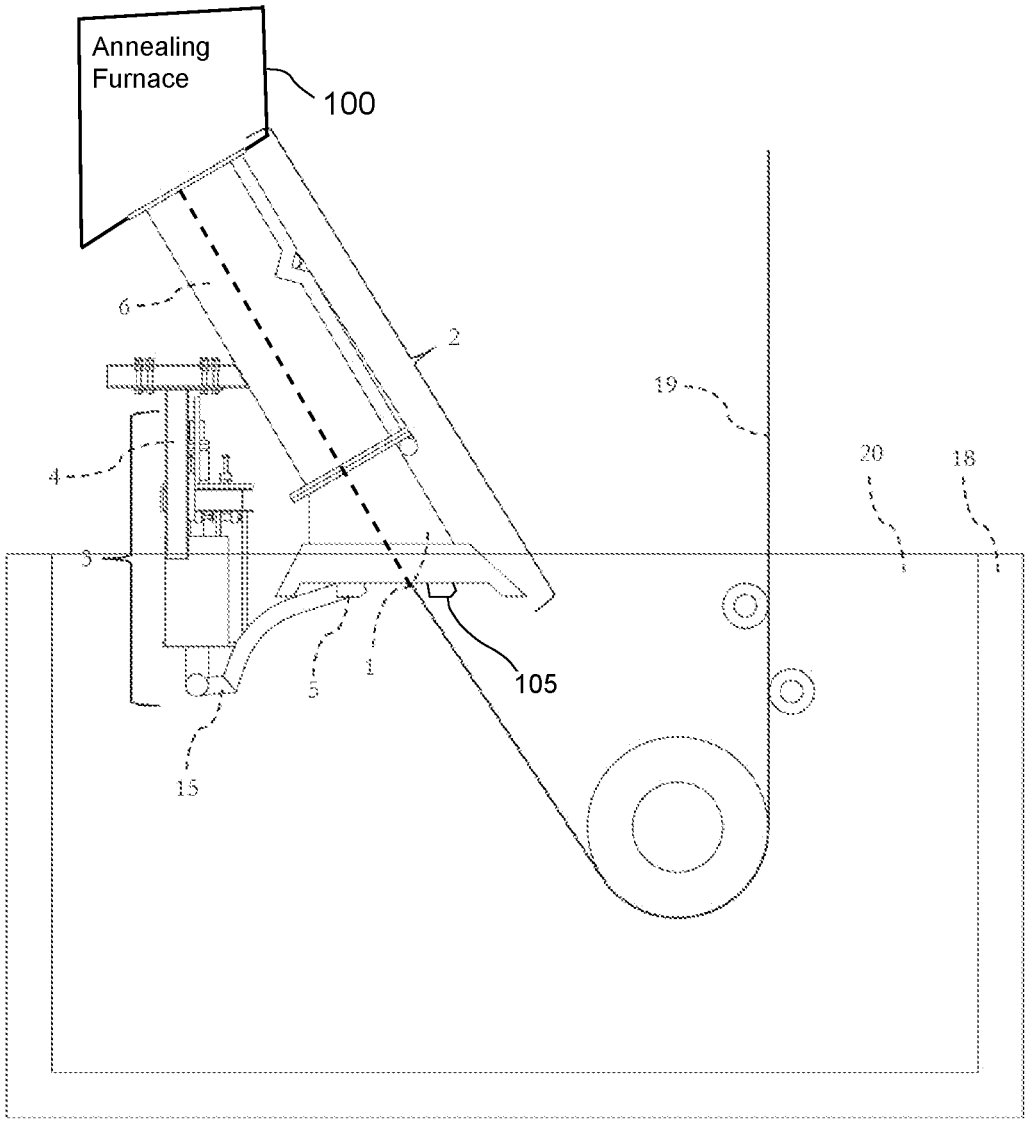
FIG. 1 shows the invention in use.

The invention relates to an equipment for the continuous hot dip-coating of a metal strip 19 comprising an annealing furnace 100 (shown schematically), a tank 18 containing a liquid metal bath 20, a snout 2 connecting the annealing furnace and said tank, through which the metal strip runs in a protective atmosphere and the lower part of said snout, the snout tip 1, is at least partly immersed in the liquid metal bath in order to define with the surface of the bath, and inside this snout, a liquid seal and a separate overflow 3 attached to the snout through fixings, said overflow comprising at least one tray 5, placed in the vicinity of the strip when entering said liquid metal bath and encompassed by said liquid seal.

In other words, the snout has one side at the end of the annealing furnace, usually high up, and the other one a bit under the liquid metal bath surface, creating a seal. Such a positioning aims to protect the metal strip against oxidation from the annealing furnace until it reaches the liquid metal bath. The overflow is located at the surface of the liquid metal bath encompassed by the snout. Said snout tip can also be referred as the sabot.

In the prior art, it seems that it is not possible to easily and quickly remove only the overflow in order to clean it, repair it or change it. Moreover, it seems that it is also not possible to remove only the part of the snout in contact with the bath in order to change it or clean it without removing the whole or a major part of snout. On the contrary, with the equipment according to the present invention, it is possible to easily remove the overflow without removing the whole snout. Furthermore, it is possible to separate the part at least partly immersed in the coating from the snout without removing the whole snout or a major part of it.

Advantageously, said fixings are attached on the upper part 6 of the snout. Such a fixing allows the removal of the snout tip when the overflow is removed.

Advantageously, said tray 5 is formed by: an internal wall 7 facing one side of the strip, directed toward the surface of the liquid seal, the upper edge 8 of which internal wall is positioned below the surface of said bath, an external wall 9 facing the snout, directed toward the surface of the liquid seal, the upper edge 10 of which external wall is positioned above the surface of said bath, a connection part 11 between said external and internal wall lower edges, a wall 12 at each shared extremity of the previous mentioned walls connecting all the edges and the internal wall edge upper edge lower than the external wall upper edge.

Advantageously, said overflow is provided with means 13 for maintaining the level of liquid metal at a level below the surface of the liquid seal in order to set up a natural flow of the liquid metal in this tray, said natural flow of the liquid metal being greater than 50 mm in order to prevent metal oxide particles and intermetallic compound particles from rising as a countercurrent to the flow of liquid metal. Possible means for maintaining the level of liquid metal in the tray can be a level indicator 17 and a pump 16, both connected to the overflow. The pump sucks liquid metal from the overflow and releases it in the bath.

Advantageously, said upper edge of the first internal wall of the tray comprises, in a longitudinal direction, a succession of hollows and projections 14. Apparently, it permits to reduce or suppress the splashing of the coating on the strip and ease the flow along the wall.

Advantageously, said tray is supported by at least one support piece 15 attached to the fixings, said support piece goes from the fixings to the liquid seal without contacting the snout.

Advantageously, said support piece can also hold means 13 for maintaining the level of liquid metal in the tray.

Advantageously, said support can be formed of several support pieces 15.

Advantageously, said the overflow is composed of at least one tray.

Apparently, it is possible that said tray continuously surrounds the metal strip.

Advantageously, said overflow is composed of 2 trays positioned symmetrically to the metal strip, second tray 105 being shown schematically in FIG. 1.

Advantageously, said separate overflow attached to the snout can be shifted vertically. Apparently, such shift can be done through the displacement of the panels along the snout. Another way to shift vertically the overflow is by using the nuts and bolts. This displacement allows a better positioning of the overflow according to the bath level.

Advantageously, said separate overflow attached to the snout can be shifted horizontally, perpendicularly to the tray length. Apparently, such shift can be done through the displacement of the T-shaped piece 25 along the U-shaped piece 21. This displacement allows a better positioning of the overflow. It permits to set the overflow at the correct distance from the strip.

The invention also relates to a method for depositing a metallic coating by hot-dip coating in an installation as described previously comprising:

- the recrystallization annealing of the steel sheet in an annealing furnace
- the passage of the steel sheet from the annealing furnace to the hot-dip coating bath in the snout
- the hot dip-coating of the annealed steel sheet in a bath The invention also relates to a method for replacing a worn lower part of a snout from a hot dip-coating process in an installation as described previously wherein:

- the overflow is removed and/or the removable lower part of the snout is removed and replaced by a new one.

The following description will concern an installation for the continuous galvanization of a metal strip. But, the present invention is applicable to every processes of continuous coating in which surface pollutants are present, the liquid seal should remain clean and the overflow needs to be removed easily.

After the cold rolling section, the metal strip passes through an annealing furnace (not represented), in a reducing atmosphere in order to recrystallize the metal strip after the strain hardening due to the cold rolling and prepare its surface state increasing the chemical reaction happening during the galvanization.

In the annealing furnace, the metal strip is heated to temperatures generally comprised between 650 and 900° C. Right after, the metal strip 19 passes in a galvanization installation as depicted in FIG. 1.

This installation comprises an annealing furnace (not represented), a tank 18 containing a liquid metal bath, said liquid metal bath is generally composed of liquid zinc containing chemical elements such as aluminum and iron as well as addition elements like possibly magnesium and antimony. The bath temperature is generally around 460° C.

After the annealing furnace, the metal strip is cooled down to a temperature close to the one of the bath and is then immerged in the metal liquid bath 20.

During this immersion, depending on the elements present in the bath, an intermetallic alloy is formed, generally Fe—Zn—Al, permitting to assure the liaison between the metal strip and the remaining zinc on said metal strip after drying.

Figure 2:
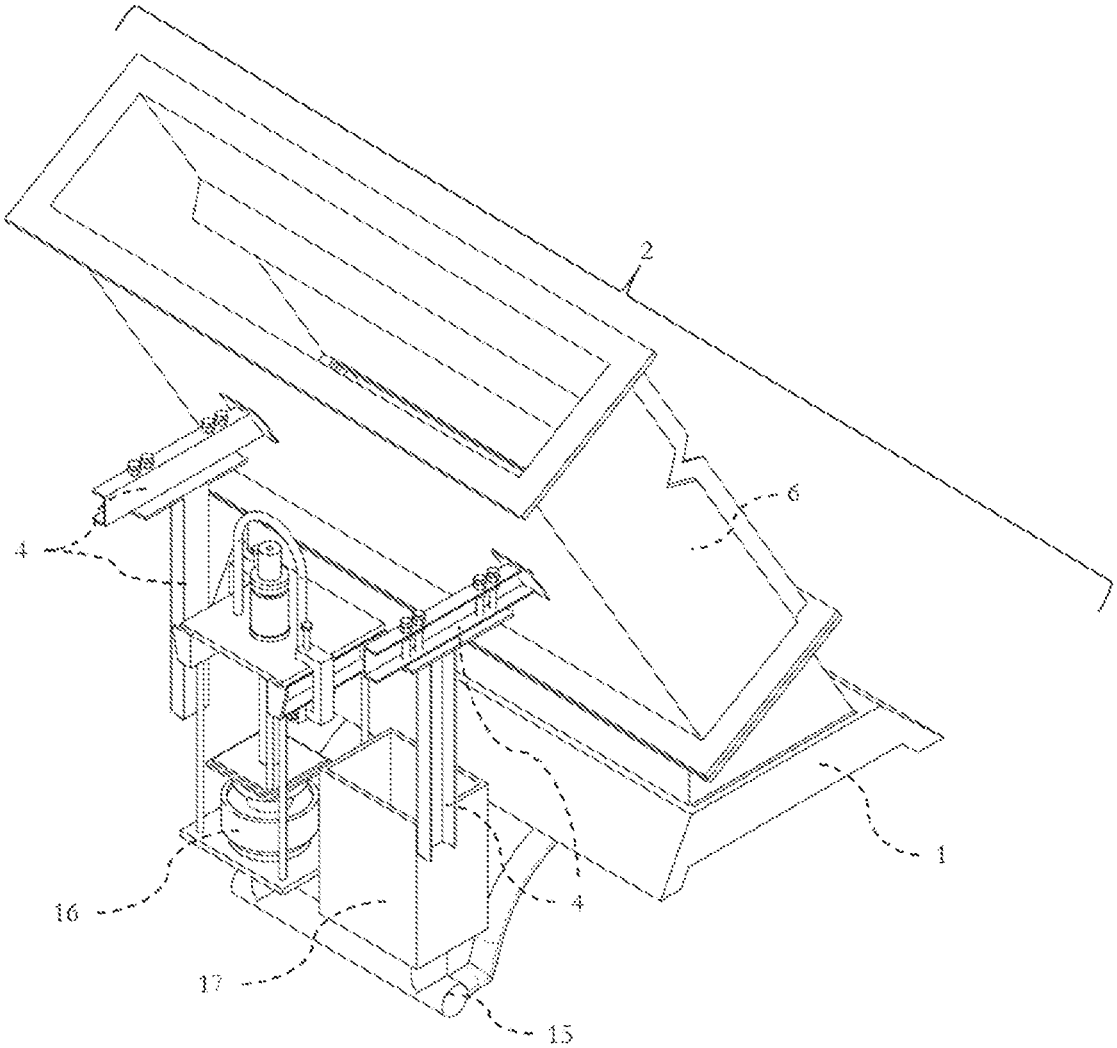
FIG. 2 exhibits the different elements of the invention.
Figure 3:
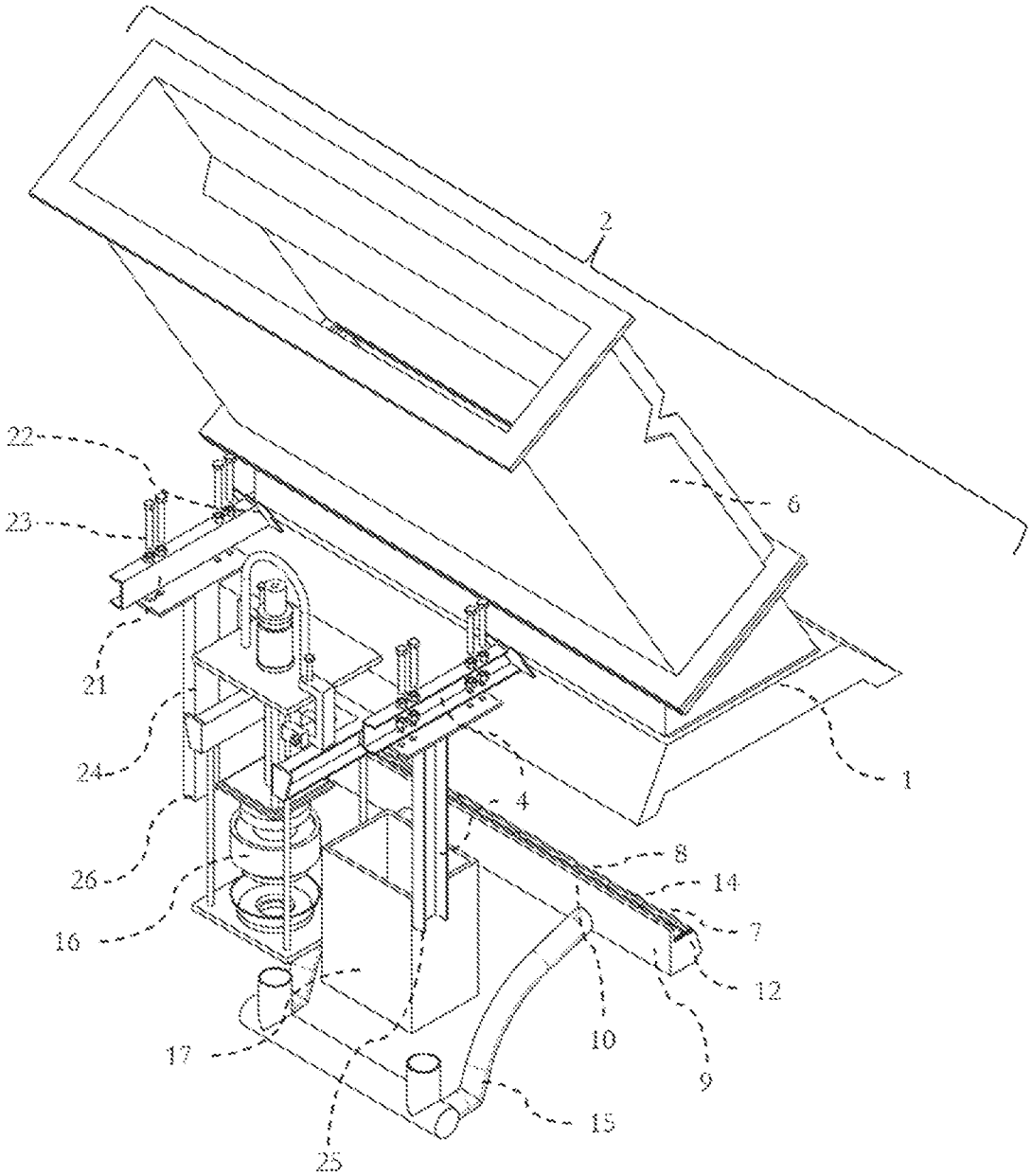
FIG. 3 is a breakdown of the different elements of the invention.

As it is represented on FIGS. 2 and 3, a part of the fixings attaching the overflow to the snout are made of U-shaped (metal) bars 21. One extremity of the U-shape bars 21 ends with a panel 22 attached to the snout. Nuts and bolts 23 are used to attached the U-shaped bars 21 to rectangular panels of a T-shaped (metal) piece 24. As previously mentioned, the T-shaped piece 24 is made of a rectangular panel positioned horizontally and a U-shaped bar positioned vertically. The two bars are oriented in a way that the nuts and bolts pass through them two times. The extremity 25 of one vertically-positioned T-shaped bar, not the rectangular one, is attached to the level indicator 17 while the second one 26 is attached to the pump 16.

Figure 4:
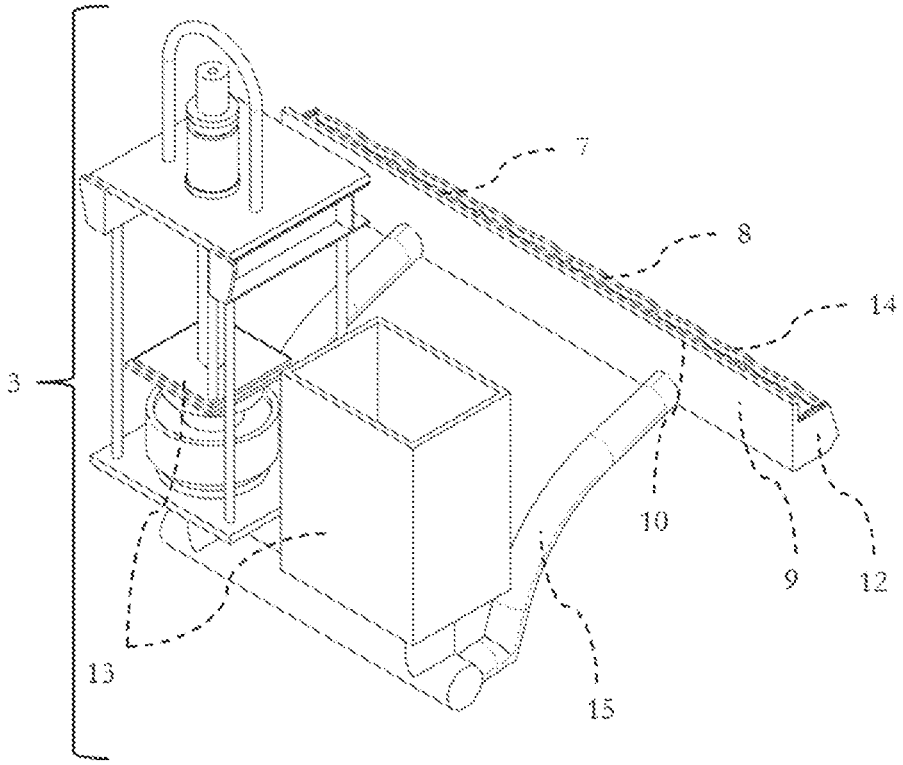
FIG. 4 is close-up view of the overflow, the pump and the level indicator.
Figure 5:
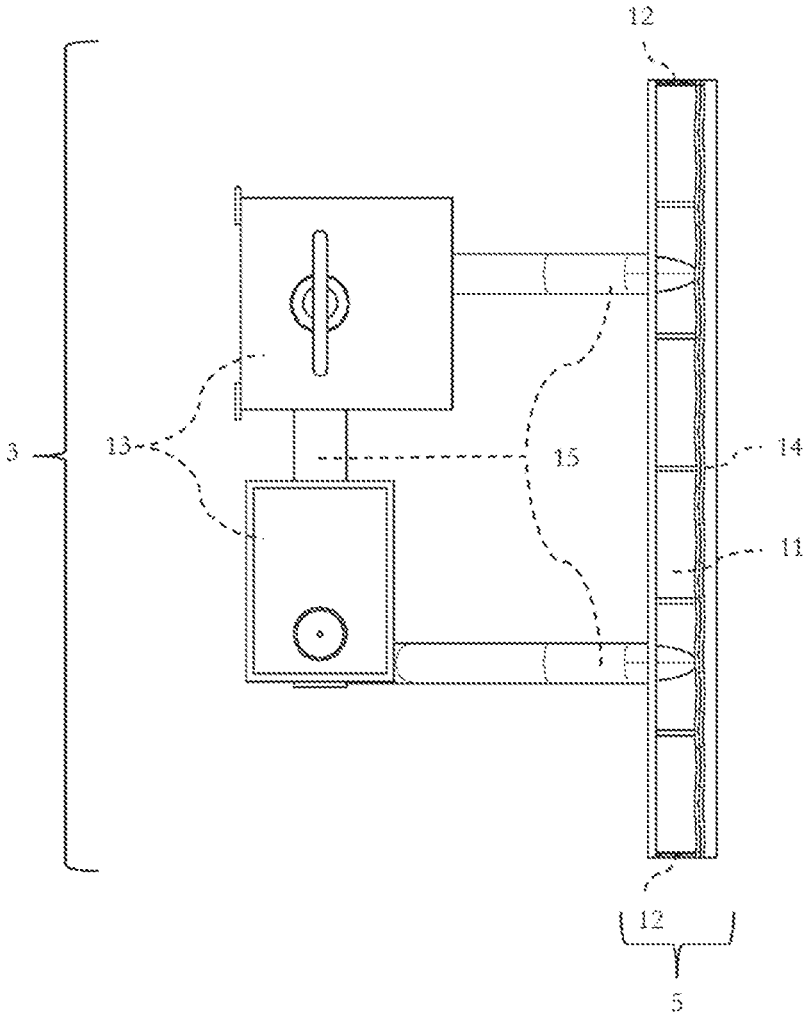
FIG. 5 is close-up view from above of the overflow, the pump and the level indicator.
Figure 6:
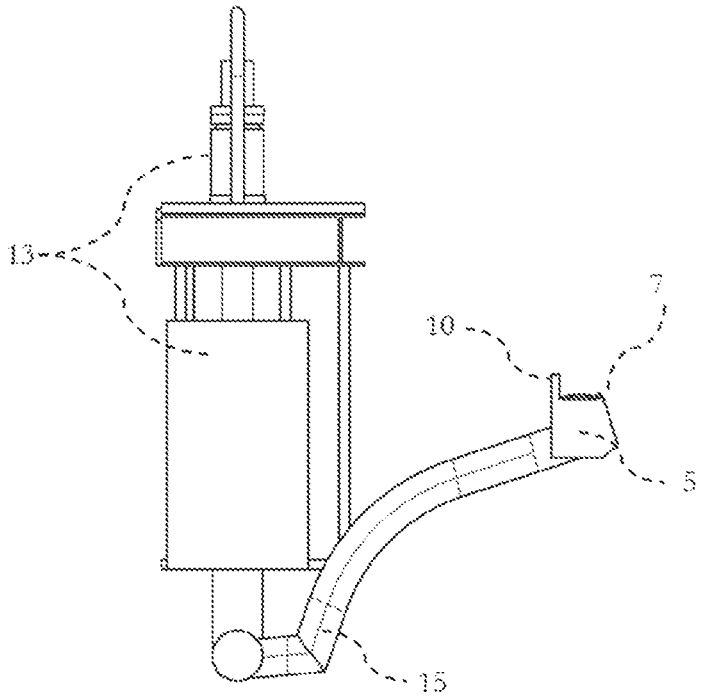
FIG. 6 is a side view of the overflow, the pump and the level indicator.

The close-up represented on FIGS. 4, 5 and 6 exhibit the overflow. It comprises a level indicator, a pump, a support and an overflow. The support is made of hollow tubes. One tube is horizontal and two small vertical tubes are attached to it vertically, on each side of the horizontal tube. Two tubes are attached to the horizontal one and attached perpendicularly to the small vertical tubes. After a short straight segment, they are curved upwardly. At the end of the curved hollow tubes is attached a tray. This whole system permits to the liquid inside the tray to flow from the tray to the pump and the level indicator. The tray being positioned in the vicinity of the snout, encompassed by the liquid seal.

Figure 7:
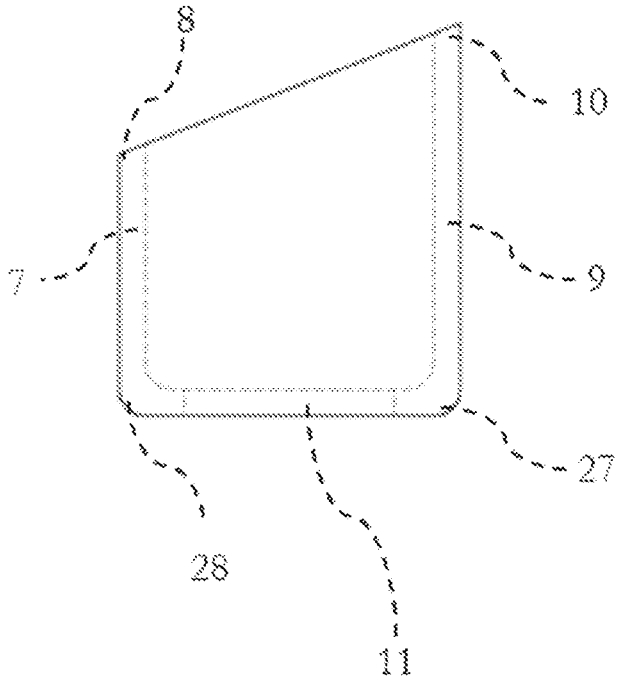
FIG. 7 exhibits a configuration for the tray.

As it is represented FIGS. 7 and 8, said tray 5 is formed by: an internal wall 7 facing one side of the strip, directed toward the surface of the liquid seal, the upper edge 8 of which internal wall is positioned below the surface of said bath, an external wall 9 facing the snout, directed toward the surface of the liquid seal, the upper edge of which external wall 10 is positioned above the surface of said bath 20, a connection part 11 between said external and internal wall lower edges respectively 27 and 28, and a wall 12 at each shared extremity of the previous mentioned walls connecting all the edges. The internal wall edge upper edge is lower than the external wall upper edge.

Figure 8:
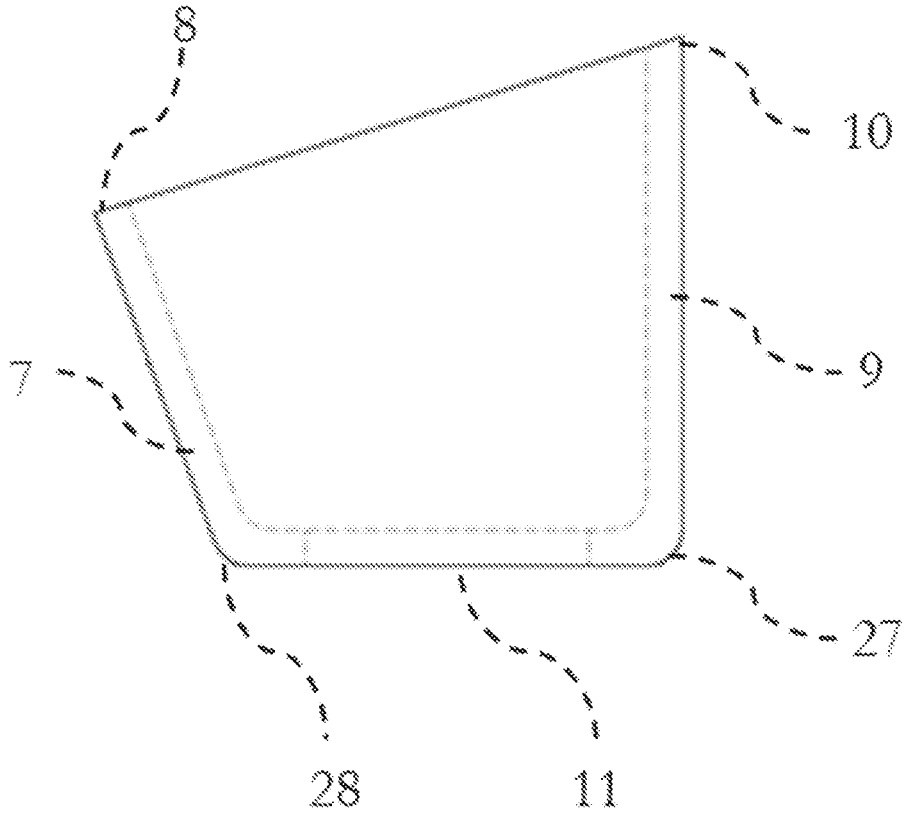
FIG. 8 exhibits a different configuration for the tray.

As it can be seen on FIG. 8, the internal wall can be slightly inclined toward the strip permitting to reduce the splash on the strip.

The skilled man should keep in mind that the width of the overflow should be wider than the width strip.

EXAMPLES

Example 1

In a particular embodiment, using the teaching of the present invention, the bath length is of 3900 mm and its width is of 2720, the snout length is of 2300 mm and 525 mm wide permitting the passage of a 1300 mm wide strip. The snout tip height is of 1283 mm when in use. The tray is of 1450 mm long and 150 mm wide and high for the external wall and 100 mm high for the internal wall.

The U-shaped part of the fixing is 600 mm long while the T-shaped part of the fixing is 750 mm high, the support piece.

The hollow tubes composing the support piece have a diameter of 800 mm. The support piece is 620 mm long and 390 high.

The level consists of a small tank represented (350×250×485 mm) and a precision laser that measures the height of the molten liquid.

The pump is a commercial molten metal pump.

The upper part of the internal wall is 120 mm below the bath side while the external wall is 70 mm below the bath side. The tray is fixed on one side to the support piece.

Example 2

In a preferred embodiment, the classical overflow (like in FR 2 816 639) has been replaced by the overflow described in this patent.

With the classical overflow, the steps necessary to change an overflow are generally the followings:

Stop the line,
Cooling (wait),
Remove bath hardware,
Lower the pot,
Move the pot to garage position,
Install platform,
Cut the strip,
Remove the snout (with the overflow),
Install the new snout (with the overflow),
Treading of the strip,
Weld the strip,
Remove the platform,
Move the pot from the garage position,
Raise the pot,
Install bath hardware,
Inert the snout,
Heat up,
Restart the line.

This procedure takes about twenty-four hours when the classical overflow is used. Whereas when the removable overflow is mounted, only the steps A, F (on the back side), H (only the overflow), I (only the overflow), L and R are done. Thus the replacement of the removable overflow takes only 4 hours, which make its replacement possible during a maintenance stop. Moreover, the strip has not to be cut and then welded.

What is claimed is:

1. An equipment for a continuous hot dip-coating of a metal strip comprising:

an annealing furnace;

a tank containing a liquid metal bath;

a snout connecting the annealing furnace and the tank, the metal strip running in a protective atmosphere through the snout, a lower part of the snout defining a snout tip and being at least partly immersed in the liquid metal bath in order to define, with a surface of the bath and an inside of the snout, a liquid seal; and a separate overflow attached to the snout, the overflow including at least one tray placed where the strip enters the liquid metal bath and is encompassed by the liquid seal;

wherein the separate overflow is attached to the snout only through fixings attached to an upper part of the snout.

2. The equipment as recited in claim 1 wherein the tray is formed by: an internal wall facing one side of the strip, directed toward a surface of the liquid seal, an upper edge of the internal wall positioned below the surface of the bath, an external wall facing the snout, directed toward the surface of the liquid seal, an upper edge of the external wall being positioned above the surface of the bath, a connection part between external and internal wall lower edges; and a lateral wall at each side connecting the internal wall and a lower wall, the internal wall upper edge being lower than the external wall upper edge.

3. The equipment as recited in claim 1 wherein the overflow is provided with means for maintaining a level of liquid metal at a level below a surface of the liquid seal in order to set up a natural flow of the liquid metal in the tray, the natural flow of the liquid metal being greater than 50 mm in order to prevent metal oxide particles and intermetallic compound particles from rising as a countercurrent to the natural flow of the liquid metal.

4. The equipment as recited in claim 3 wherein the upper edge of the internal wall of the tray includes, in a longitudinal direction, a succession of hollows and projections.

5. The equipment as recited in claim 1 wherein the tray is supported by a support piece attached to the fixings, the support piece extending from the fixings to the liquid seal without contacting the snout.

6. The equipment as recited in claim 1 wherein the fixings hold means for maintaining a level of liquid metal in the tray.

7. The equipment as recited in claim 5 wherein the support piece includes several pieces.

8. The equipment as recited in claim 5 wherein the overflow is composed of two trays positioned symmetrically to the metal strip.

9. The equipment as recited in claim 1, wherein the overflow attached to the snout is shiftable vertically.

10. The equipment as recited in claim 1, wherein the overflow attached to the snout is horizontally shiftable perpendicularly to a length of the tray.

11. The equipment as recited in claim 1, wherein the tray is not secured to the snout except through said fixings.

12. The equipment as recited in claim 1, wherein the fixings are attached to an exterior surface of the upper part of the snout.

13. The equipment as recited in claim 12, wherein the tray is not secured to the snout except through said fixings attached to an exterior surface of the upper part of the snout.

14. The equipment as recited in claim 5, wherein the tray is not secured to the snout except through said support piece and said fixings.

15. The equipment as recited in claim 1, wherein said snout includes said upper part and a snout tip, and wherein the tray is not attached to said snout tip.

* * * * *